US008988328B2

(12) United States Patent
Kishi

(10) Patent No.: US 8,988,328 B2
(45) Date of Patent: Mar. 24, 2015

(54) DISPLAY DEVICE CONFIGURED TO SUPPLY A DRIVING CURRENT IN ACCORDANCE WITH A SIGNAL VOLTAGE SELECTED BASED ON A TEMPERATURE DEPENDENCY OF THE DRIVING CURRENT AND DRIVING METHOD THEREOF

(75) Inventor: Noritaka Kishi, Uda (JP)

(73) Assignee: Sharp Kabushiki Kaisha, Osaka (JP)

( * ) Notice: Subject to any disclaimer, the term of this patent is extended or adjusted under 35 U.S.C. 154(b) by 1201 days.

(21) Appl. No.: 12/310,162

(22) PCT Filed: Jul. 24, 2007

(86) PCT No.: PCT/JP2007/064478

§ 371 (c)(1),
(2), (4) Date: Feb. 13, 2009

(87) PCT Pub. No.: WO2008/065778

PCT Pub. Date: Jun. 5, 2008

(65) Prior Publication Data

US 2010/0001932 A1 Jan. 7, 2010

(30) Foreign Application Priority Data

Nov. 30, 2006 (JP) ..... 2006-323843

(51) Int. Cl.
*G09G 3/30* (2006.01)
*G09G 3/36* (2006.01)
*G09G 3/32* (2006.01)

(52) U.S. Cl.
CPC ..... *G09G 3/3225* (2013.01); *G09G 2320/0233* (2013.01); *G09G 2320/041* (2013.01)
USPC ..... 345/77; 345/101

(58) Field of Classification Search
None
See application file for complete search history.

(56) References Cited

U.S. PATENT DOCUMENTS

| | | | | |
|---|---|---|---|---|
| 5,977,832 | A * | 11/1999 | Satyanarayana et al. | 330/289 |
| 6,249,265 | B1 * | 6/2001 | Tajima et al. | 345/63 |
| 6,376,994 | B1 * | 4/2002 | Ochi et al. | 315/169.1 |
| 6,462,722 | B1 | 10/2002 | Kimura et al. | |
| 2002/0024493 | A1 | 2/2002 | Ozawa et al. | |
| 2002/0097213 | A1 | 7/2002 | Ozawa et al. | |
| 2002/0105279 | A1 * | 8/2002 | Kimura | 315/169.3 |
| 2002/0196206 | A1 | 12/2002 | Kimura et al. | |
| 2003/0098827 | A1 | 5/2003 | Ozawa et al. | |
| 2003/0107564 | A1 * | 6/2003 | Miyazawa | 345/204 |
| 2003/0231273 | A1 | 12/2003 | Kimura et al. | |
| 2004/0012550 | A1 * | 1/2004 | Koyama | 345/76 |

(Continued)

FOREIGN PATENT DOCUMENTS

| | | |
|---|---|---|
| JP | 3528182 | 3/2004 |
| JP | 2004-170943 | 6/2004 |

(Continued)

*Primary Examiner* — Grant Sitta
*Assistant Examiner* — Kirk Hermann
(74) *Attorney, Agent, or Firm* — Harness, Dickey & Pierce, P.L.C.

(57) ABSTRACT

In a display device including a driving transistor a driving current flows in accordance with a signal voltage supplied via a data line, so that gray scale display in accordance with the signal voltage is carried out. An electro-optical element emits light in response to the driving current. The driving transistor is provided with a signal voltage at displaying a center gray scale among all display gray scale levels within a voltage region in which the driving current in a temperature range of 0° C. to 40° C. is in a range of 98% to 102% of a driving current that flows at an average driving temperature.

21 Claims, 7 Drawing Sheets

(56) References Cited

U.S. PATENT DOCUMENTS

| | | | | |
|---|---|---|---|---|
| 2004/0100463 | A1 | 5/2004 | Miyagawa et al. | |
| 2004/0130539 | A1* | 7/2004 | Yabu et al. | 345/204 |
| 2004/0150591 | A1 | 8/2004 | Ozawa et al. | |
| 2004/0246202 | A1 | 12/2004 | Yamashita | |
| 2005/0052448 | A1 | 3/2005 | Hayafuji et al. | |
| 2005/0280626 | A1* | 12/2005 | Amundson et al. | 345/107 |
| 2006/0027822 | A1* | 2/2006 | Choi et al. | 257/94 |
| 2006/0038804 | A1 | 2/2006 | Hayakawa et al. | |
| 2006/0071352 | A1* | 4/2006 | Glasse et al. | 257/900 |
| 2006/0273995 | A1 | 12/2006 | Ozawa et al. | |
| 2006/0273996 | A1 | 12/2006 | Ozawa et al. | |
| 2006/0279491 | A1 | 12/2006 | Ozawa et al. | |
| 2007/0085474 | A1* | 4/2007 | Spindler et al. | 313/506 |
| 2007/0132793 | A1 | 6/2007 | Miyagawa et al. | |
| 2008/0246700 | A1 | 10/2008 | Ozawa et al. | |

FOREIGN PATENT DOCUMENTS

| | | |
|---|---|---|
| JP | 2004-302289 | 10/2004 |
| JP | 2005-049378 | 2/2005 |
| JP | 2005-077824 | 3/2005 |
| JP | 2006-047984 | 2/2006 |
| JP | 2006-215296 | 8/2006 |
| WO | WO 2005114630 A1 * | 12/2005 |

* cited by examiner

DISPLAY DEVICE CONFIGURED TO SUPPLY A DRIVING CURRENT IN ACCORDANCE WITH A SIGNAL VOLTAGE SELECTED BASED ON A TEMPERATURE DEPENDENCY OF THE DRIVING CURRENT AND DRIVING METHOD THEREOF

TECHNICAL FIELD

The present invention relates to a display device using a current-control type electro-optical element such as an organic EL (Electro Luminescence) element, an FED (Field Emission Display) element, or an LED (Light Emitting Diode) element, and a driving method of the display device.

BACKGROUND ART

In recent years, active-matrix type display devices using a current-control type self-luminous electro-optical element has been proposed. Examples of such a self-luminous electro-optical element are an organic EL element, an FED element, and an LED element. Advantages of using such a current-control type self-luminous electro-optical element are such that: (i) the number of components can be reduced because a backlight is not necessary; (ii) a degree of dependence on a viewing angle is light; and (iii) power consumption can be reduced.

The current-control type self-luminous electro-optical element means an electro-optical element that has a characteristic such that the electro-optical element itself emits light and a luminance of the light emission depends on a current.

Generally, in a current-control type self-luminous electro-optical element, a luminance is proportional to a current. Meanwhile, a relationship between the luminance and a voltage easily varies depending on, for example, a driving period or a surrounding temperature. Accordingly, it is difficult to prevent unevenness in luminance by driving, according to a voltage-control type driving method, the current-control type self-luminous electro-optical element such as an organic EL element.

It is preferable to drive, according to a current-control type driving method, the current-control type self-luminous electro-optical element that has a characteristic such that a luminance depends on a current.

Further, when a display device using a current-control type self-luminous electro-optical element is driven in an active matrix, voltage-current conversion can be carried out by a transistor constituting the active matrix. As a result, control of a current for a luminance becomes possible. Moreover, a light emission period can be freely controlled by combining the transistor with a switching element. Furthermore, it becomes possible to have a reduced power consumption or lengthening a life duration of the electro-optical element.

As a transistor constituting the conventional active matrix, a TFT (Thin Film Transistor) formed on a substrate is used. An active matrix using this TFT can achieve a light weight, a small thickness, and a high quality of the display device. Accordingly, such an active matrix is widely used for the purpose of driving an electro-optical element. As a material of the TFT, for example, amorphous silicon, low-temperature polycrystal silicon, or CG (Continuous Grain) silicon is used.

The following explains a conventional active-matrix type display device using a current-control type self-luminous electro-optical element and a driving method of the display device.

Various configurations have been proposed as an active-matrix type driving circuit using a TFT. Among the proposed configurations, the simplest configuration is a driving circuit called a 2TFT+1C (Condenser) type.

FIG. 3 is a diagram illustrating an equivalent circuit of one pixel in a 2TFT+1C type driving circuit.

As shown in FIG. 3, in a pixel 10, a second TFT 32 and an EL element 20 are provided in series in a path connecting a power supply line 4 and a ground 50. Moreover, a retention capacitor 21 and a first TFT 31 are provided in series between the power supply line 4 and a data line (Sj) 2. The first TFT 31 and the second TFT 32 are P-channel type transistors.

A gate electrode 71 of the first TFT 31 is connected to a scanning line (Gi) 3, and a gate electrode 74 of the second TFT 32 is connected to a drain electrode 73 of the first TFT 31. The second TFT 32 functions as a driving TFT for controlling an amount of current that flows into the EL element 20.

For causing a pixel 10 to emit light at a luminance in accordance with image data, a low level potential is provided to the scanning line (Gi) 3 and a potential (hereinafter, referred to as a potential Da) in accordance with the image data is provided to the data line (Sj) 2. At this time, the first TFT 31 becomes conductive and a gate electrode potential of the second TFT 32 becomes equal to the potential Da.

When the potential of the scanning line (Gi) 3 becomes a high-level potential subsequently, the first TFT 31 becomes non-conductive and the gate electrode potential of the second TFT 32 becomes fixed to the potential Da due to an influence of the retention capacitor 21.

Then, an amount of the driving current to be supplied to the EL element 20 via the second TFT 32 varies according to a gate electrode potential of the second TFT 32. The EL element 20 emits light at a luminance in accordance with the amount of the driving current supplied via the second TFT 32.

The driving current at this time is provided, in a case where the second TFT 32 operates in a saturation region, according to $$I_{OLED}=1/2\mu\cdot Cox\cdot W/L(Da-Vth)^2,$$

where: $I_{OLED}$: driving current; μ: mobility; Cox: conductance; W: channel width; L: channel length; Da: potential in accordance with image data; and Vth: threshold value.

In this way, the EL element 20 emits light at a luminance in accordance with the potential Da.

As a method of controlling the data signal line 2 or the scanning line 3, a general method is used. One example of a voltage condition or the like of a section in the circuit is disclosed in, for example, Patent Document 1.

[Patent Document 1] Japanese Patent Publication No. 3528182 (registered on Mar. 5, 2004)

[Patent Document 2] Japanese Unexamined Patent Publication No. 215296/2006 (Tokukai 2006-215296) (published on Aug. 17, 2006)

[Patent Document 3] Japanese Unexamined Patent Publication No. 47984/2006 (Tokukai 2006-47984) (published on Feb. 16, 2006)

DISCLOSURE OF INVENTION

However, a conventional active-matrix type display device using a current-control type self-luminous electro-optical element has a problem in that luminance unevenness in display occurs because a current-voltage characteristic of a TFT is dependent on temperature.

That is, temperature gradient occurs when a temperature surrounding a driving element rises locally in a display screen due to, for example, an influence of an outside temperature or heat generation of partially lighted electro-optical elements.

In a case where the temperature gradient occurs, a conductance of the driving element varies even when the same signal voltage is written into the driving voltage. This produces luminance unevenness.

In other words, even when display of an image of the same gray-scale level is intended, luminance unevenness occurs in a case where a temperature surrounding the driving voltage is different due to, for example, the last gray-scale level at which the electro-optical element is lighted. The following provides a further explanation.

This problem becomes more prominent, when an ON voltage (Da) provided to the driving element in the driving circuit of the pixel is set to a narrow low range for reduction of power consumption, in a display device in which one element is commonly used for, for example, a driving circuit of the pixel and a surrounding circuit such as a driver. A case that falls into such a case is, for example, a case, as described in Patent Document 2, where a data voltage oscillation, that is, a driving voltage range is set to approximately 0 V to 2 V, or 0 V to 3 V.

That is, in such a low driving voltage range, an absolute value of a threshold shifts in a direction in which the absolute value becomes lower in a case where a temperature of the driving element becomes high. This increases a current. Consequently, a luminance becomes high. Because a person tends to recognize more luminance unevenness caused by a high luminance pixel, compared with luminance unevenness caused by a low luminance pixel. Accordingly, luminance unevenness tends to be conspicuous. The following provides an explanation with reference to a drawing.

FIG. 6 is a diagram illustrating a relation between a driving voltage and a current in a conventional driving circuit and a driving voltage range.

As shown in FIG. 6, in the conventional driving circuit, a range of Da (a gate-source voltage of the driving TFT provided in the driving element: Vgs) is in a low voltage region, in view of low power consumption, and the range is narrow. Accordingly, the temperature coefficient is positive (the current increases as the temperature rises) all over the gray scale levels. In particular, on a low luminance side, that is, in a region in which Vgs is a low voltage, the luminance is heavily dependent on the temperature. Accordingly, in relation to temperature variation, in particular, in relation to a rise in temperature, luminance unevenness tends to become conspicuous.

In order to solve this problem, as means to prevent variation in luminance due to temperature variation, for example, Patent Document 3 discloses a technique to add a mechanism such as a limiter transistor. However, this technique is incapable of performing compensation to a local temperature rise in a display panel. Moreover, increase in cost or increase in mounting area occurs because an additional control means needs to be provided.

The present invention is attained in view of the conventional problems. An object of the present invention is to provide a display device that allows reduction in the occurrence of luminance unevenness of the electro-optical element due to temperature variation of outside air or local temperature variation in a display panel, while neither cost nor mounting area is increased, and a driving method of the display device.

In order to solve the problem mentioned above, a display device of the present invention includes: pixels in each of which at least a driving transistor and a electro-optical element are formed; and a data line, the driving transistor supplying a driving current in accordance with a signal voltage into the electro-optical element so as to carry out gray scale display in accordance with the signal voltage supplied via the data line, the electro-optical element emitting light in response to the driving current, the signal voltage, at displaying a center gray scale among all display gray scale levels, being supplied to the driving transistor, the signal voltage being within a voltage region in which a driving current in a temperature range of 0° C. to 40° C. is in a range of 98% to 102% of a driving current that flows at an average driving temperature.

According to the present invention, a driving method of a display device including: at least pixels in each of which a driving transistor and an electro-optical element are formed; and a data line, in which driving method, for carrying out gray scale display in accordance with a signal voltage supplied via the data line, the electro-optical element is caused to emit light by flowing, with use of the driving transistor, a driving current in accordance with the signal voltage into the electro-optical element, the driving method includes the step of: supplying, to the driving transistor, the signal voltage within a voltage region in which the driving current flowing in a temperature range of 0° C. to 40° C. into the electro-optical element is in a range of 98% to 102% of a driving current that flows at an average driving temperature.

According to the arrangement, the signal voltage that is supplied to the driving transistor so as to display a center gray scale level (hereinafter, referred to as center gray scale) among all display gray scale levels is set within a voltage region in which a driving current in a temperature range of 0° C. to 40° C. is in a range of 98% to 102% of a driving current that flows at the average driving temperature. Accordingly, temperature dependence of luminance is reduced. This is explained below.

In general, a current-voltage characteristic of a transistor tends to vary depending on temperature. The current-voltage characteristic here indicates how a current flowing out from a transistor with respect to a voltage applied to the transistor varies in accordance with temperature variation.

The variation in the current-voltage characteristic due to temperature (hereinafter, referred to as temperature dependence of current-voltage characteristic) is considered to occur because, when temperature varies, a threshold value varies due to increase/decrease of a capacity of a depletion layer or a mobility varies due to expansion/contraction of a mean free path.

In a case where a display element driven by a transistor is a current-control type photoelectric-optical element such as an EL element, luminance unevenness occurs due to temperature because of the temperature dependence of the current-voltage characteristic of the transistor.

As a result of examining the temperature dependence of the current-voltage characteristic of the transistor for solving the problem, it is found that there is a voltage region in which the temperature dependence is low. In other words, it is considered regarding a transistor that, generally, as a temperature rises, a threshold value decreases due to an increase in a capacity of a depletion layer and a mobility decreases due to a contraction of a mean free path.

In a low voltage region, variation in the threshold value is more influential than that of the mobility when a current value is determined. Accordingly, as a temperature rises, a current value increases.

On the contrary, in a high voltage region, variation in the mobility is more influential than that of the threshold value when a current value is determined. Accordingly, as a temperature rises, a current value decreases.

At the point where the increase in the current value accompanying the rise in the temperature comes to an equilibrium with the decrease in the current value accompanying the rise in the temperature, the variation in the current value due to temperature variation, that is, temperature dependence of the current value disappears. In addition, in the vicinity of the equilibrium, there is a region in which the temperature dependence of the current value is low.

In the present invention, the signal voltage supplied to the driving transistor for displaying the center gray scale is set within a voltage region, in which the temperature dependence of the current value is low and a driving current in a temperature range of 0° C. to 40° C. is in a range of 98% to 102% of a driving current that flows at an average driving temperature. That is, a signal voltage for displaying a middle gray scale level of the number of all display gray scale levels is set within a region in which the temperature dependence of the current-voltage characteristic is the lowest. This makes it possible to reduce luminance unevenness over all gray scale levels.

A range of current variation is set in a range of 98% to 102%, that is, a difference of current values is set in a range of −2% to +2%. This is because a difference in luminance that occurs in this range is a difference in luminance that human eyes are hard to recognize. This is explained below.

As a reference for evaluation of a value of color difference, there is an NBS (National Bureau of Standard) unit according the NBS (National Bureau of Standards). According to this standard, an upper limit of a noticeable color difference is defined as $\Delta L^*<1.5$ in terms of a shift amount in an L*a*b* color solid. In the case of a single color, according to calculation based on a formula of $L^*=116(Y/Y_0)^{1/3}-16$, $\Delta L^*$ becomes approximately 1.5 when $\Delta Y=4\%$. On the assumption that the luminance and the current value are proportional, a variation in the current value should be set in a range of −2% to +2%. Note that Y is a stimulus value of an object and $Y_0$ is a stimulus value of a perfect reflecting diffuser.

According to the arrangement above, the signal voltage of the center gray scale is set so that the driving current in the temperature range of 0° C. to 40° C. is in the range of 98% to 102% of the driving current that flows at the average driving temperature. Accordingly, not only at the center gray scale but also in all gray scale levels, the temperature dependence of the luminance becomes low.

Further, according the arrangement above, no additional component or the like is required for reducing the temperature dependence of the luminance.

Accordingly, it is possible to provide, without cost increase or increase in mounting area, a display device in which the occurrence of luminance unevenness of the electro-optical element due to outside temperature variation or local temperature variation in the display panel is reduced, and a driving method of the display device.

A ratio of a driving current at a temperature (0° C. to 40° C.) other than the average driving temperature with respect to the driving current at the average driving temperature is calculated by $[\{(Id2-Id1)/Id1\}-1]\times100$ in relation to the current (Id1) at the average driving temperature and the current (Id2) at a temperature other than the average driving temperature.

The description "center gray scale among all display gray scale levels" indicates an $(N/2)^{th}$ gray scale level with respect to the number N of all display gray scale levels in a case where the number of the all display gray scale levels is the even number. Meanwhile, the same description indicates an $\{(N+1)/2\}^{th}$ gray scale level with respect to the number N of all display gray scale levels in a case where the number of the all display gray scale levels is the odd number. Hereinafter, the "center gray scale level in all display gray scale level" is referred to as "center gray scale".

The "temperature" means a temperature on a surface of a substrate in a position where the transistor is formed. For example, in a case where a TFT transistor is formed on a glass substrate, the temperature is obtained by measuring a temperature of a surface of the glass substrate.

The "average driving temperature" means an average temperature of an operation temperature. The average temperature is estimated according to, for example, a usage environment of the display device. Examples of the average driving temperature are 25° C. and 27° C.

The temperature 0° C. to 40° C. is determined based on an average operation range of the display device.

The signal voltage indicates a voltage applied for transmitting a signal.

In a display device of the present invention, it is preferable that: the signal voltage, at displaying the center gray scale among the all display gray scale levels, is supplied to the driving transistor, the signal voltage being within a voltage region in which the driving current in the temperature range of 0° C. to 40° C. is in a range of {1−(1/a number of the all display gray scale levels)}×100% to {1+(1/the number of the all display gray scale levels)}×100% of the driving current that flows at the average driving temperature.

According to the arrangement, because a range of the current variation is in a range of {1−(1/the number of the all display gray scale levels)}×100% to {1+(1/the number of the all display gray scale levels)}×100%. That is a difference in currents is in a range of −(1/the number of the all display gray scale levels)×100% to −(1/the number of the all display gray scale levels)}×100%. This prevents the occurrence of gray scale inversion, and reduces the occurrence of luminance unevenness.

In the display device of the present invention, it is preferable that: the temperature range is from 0° C. to 80° C.

According to the arrangement, the upper limit temperature of a temperature range is defined by adding, to the temperature range of 0° C. to 40° C. considered as a range of a value of an average operation temperature of the display device, heat that is generated by the electro-optical element such as an EL element and experimentally estimated to be approximately 40° C. Accordingly, the occurrence of luminance unevenness can be reduced, for example, even in a case where the display device is lighted for a long time.

In the display device of the present invention, it is preferable that: the average driving temperature is 25° C.

According to the arrangement, the average operation temperature is set to 25° C. that is a typical operation temperature. Accordingly, in many usage occasions, the occurrence of luminance unevenness can be reduced.

In the display device of the present invention, it is preferable that: the gray scale display is carried out by amplitude modulation.

According to the arrangement, though temperature dependence of the current value generally tends to become high in amplitude modulation (analog gray scale driving) for expressing a luminance by voltage oscillation, the temperature dependence can be reduced all over the voltage range (in the all gray scale levels) by arranging the temperature dependence at the center gray scale to be a minimum level. This makes it possible to reduce the occurrence of the luminance unevenness.

In the display device of the present invention, it is preferable that: the gray scale display is carried out by time modulation.

In the case of the time modulation, that is, a time-sharing digital gray scale driving, a momentary luminance of emitted light is identical in the all gray scale levels. However, the gray scale is realized by making a light emission period different.

According to the arrangement, a light emitting point that is a voltage producing the luminance of emitted light is set in a voltage region in which temperature dependence of a current value of the transistor is low. Accordingly, the temperature dependence is barely seen in the current flowing in the electro-optical element. Accordingly, it is possible to display an image in which luminance unevenness occurs little even when temperature varies.

In this case, the voltage applied to the transistor is constant for the all display gray scale levels. Accordingly, the signal voltage for displaying the center gray scale also may be included in a voltage region in which the driving current is in a range of 98% to 102% of the driving voltage at the average driving temperature or in a range of {1−(1/the number of the all display gray scale levels)}×100% to {1+(1/the number of the all display gray scale levels)}×100%.

The display device of the present invention, it is preferable that: in a case where a comparison is made between: (a) a difference between the driving current that flows at 0° C. and the driving current that flows at 40° C., the driving currents being caused by the driving voltage supplied to the driving transistor so as to display the center gray scale among the all display gray scale levels; and (b) a difference between the driving current that flows at 0° C. and the driving current that flows at 40° C., the driving currents being caused by the driving voltage supplied to the driving transistor so as to display a gray scale level that is one level higher than the center gray scale among the all display gray scale levels, the signal voltage supplied to the driving transistor for displaying the center gray scale is set within a voltage region in which the difference at displaying the gray scale level that is one level higher than the center gray scale level becomes smaller.

In a case where a bright luminance is displayed, much current flows into the electro-optical element. Accordingly, the temperature rise due to lightening becomes larger compared with that in a case where a dark luminance is displayed. Accordingly, on a bright luminance side, luminance unevenness tends to occur due to the temperature rise. Therefore, it is effective to arrange such that the temperature dependence of the current value on the bright luminance side is lower than that on a dark luminance side.

Regarding this point, according to the arrangement, the signal voltage of the center gray scale is set so that the temperature dependence of the current value of a gray scale level one level higher than the center gray scale becomes lower than the temperature dependence of the current value at the center gray scale. Accordingly, it becomes easier to prevent the occurrence of the luminance unevenness on the bright luminance side. As a result, in a whole screen, the occurrence of the luminance unevenness can be reduced. This is explained in detail below.

Generally, regarding a current-voltage characteristic of a transistor, in a low voltage region, the current value becomes higher as the temperature becomes higher (the temperature dependence of the current value is positive). On the other hand, in a high voltage region, the current value becomes lower as the temperature becomes higher (the temperature dependence of the current value is negative). On the boundary between the low voltage region and the high voltage region, there is a voltage (a voltage at which the temperature dependence of the current value disappears) at which a current value in the case of a high temperature becomes the same as a current value in the case of a low temperature. As the voltage goes farther in a lower voltage direction or a higher voltage direction away from a voltage at which the temperature dependence of the current value disappears, the temperature dependence becomes higher. That is, a difference between the current value at a high temperature and the current value at a low temperature becomes larger.

This is explained in another way as follows. In a case where, in coordinate axes where a horizontal axis represents voltage and a vertical axis represents current, (i) a curve in which a relation between current and voltage at a high temperature is plotted is assumed to be a high temperature curve and (ii) a curve in which a relation between current and voltage at a low temperature is plotted as assumed to be a low temperature, there is a point where the high temperature curve and the low temperature curve intersects. On a side where voltage is lower than that of the intersection, the high temperature curve is positioned on an upper side of the low temperature curve.

In the transistor that has such a current-voltage characteristic, it means to set the signal voltage at the center gray scale in the voltage region in which the temperature dependence of the current is positive, that the signal voltage at the center gray scale is set so that the temperature dependence of the current value at a gray scale level one level higher than the center gray scale is lower than the temperature dependence of the current value at the center gray scale.

In a case where the signal voltage at the center gray scale is set in such a voltage region, the temperature dependence of the current value diminishes on a side of a luminance brighter than a luminance of the center gray scale. Accordingly, the occurrence of luminance unevenness can be further reduced.

It is preferable that the display device of the present invention further includes: a gate electrode and a source electrode formed in the driving transistor; a switching transistor formed between the data line and the gate electrode of the driving transistor; and a retention capacitor formed between the gate electrode of the driving transistor and the source electrode of the driving transistor, the signal voltage being supplied to the driving transistor via the switching transistor in a period in which the switching transistor is on, the signal voltage, that is supplied to the driving transistor in the period in which the switching transistor is on, being retained by a capacitor stored in the retention capacitor in a period in which the switching transistor is off.

The arrangement makes it possible to hold the driving transistor with the use of the retention capacitor. This reduces a momentary luminance so that a life duration of the driving transistor is lengthened. At the same time, because the temperature dependence of the current value at the center gray scale is low, reduction in power consumption becomes possible. In addition, the occurrence of luminance unevenness can be further reduced.

In the display device of the present invention, it is preferable that: the electro-optical element is an organic EL element.

This arrangement can improve display efficiency of the display device and also lengthen a life duration of the display device. Further, because a relation between the driving current and the luminance of emitted light is substantially constant regardless of temperature in an organic EL element, the occurrence of luminance unevenness can be further reduced.

In the display device of the present invention, it is preferable that: the driving transistor is a thin film transistor and includes a channel region made of polycrystalline silicon.

According to the arrangement, when a thin film transistor made of polycrystalline silicon is used in the display device, a design of the transistor becomes easy. This is because the thin film transistor made of polycrystalline silicon has low temperature dependence of a current value particularly in a voltage region in which an overdrive voltage is some volts.

In the display device of the present invention, it is preferable that: the pixels include at least three kinds of pixels including a pixel displaying a red color, a pixel display a green color, and a pixel displaying a blue color.

In monochrome display, variation in display quality is caused only by luminance unevenness of each pixel. However, in color display, variation in display quality is caused by not only the luminance unevenness of each pixel but also unevenness in color of each pixel. Accordingly, in the color display, a tolerance in luminance unevenness of each pixel is smaller than that of the monochrome display.

Regarding this point, in the display device of the present invention, luminance unevenness is suppressed. Accordingly, the display device of the present invention makes it possible to further suppress deterioration of the display quality in the color display.

In order to solve the problem mentioned above, a display device of the present invention includes: pixels in each of which at least a driving transistor and a electro-optical element are formed; and a data line, the driving transistor supplying a driving current in accordance with a signal voltage into the electro-optical element so as to carry out gray scale display in accordance with the signal voltage supplied via the data line, the electro-optical element emitting light in response to the driving current, the signal voltage, at displaying a center gray scale among all display gray scale levels, being supplied to the driving transistor, the signal voltage being within a voltage region in which a color difference between light emitted in a temperature range of 0° C. to 40° C. and light emitted at an average driving temperature is $\Delta L^*<1.5$ in an L*a*b* color solid.

According to the arrangement, the signal voltage is set so that the color difference caused by temperature variation is in a range unnoticeable to human beings.

Accordingly, it becomes possible to provide, without cost increase or increase in mounting area, a display device that realizes reduction in the occurrence of luminance unevenness of the electro-optical element due to outside temperature variation or temperature variation that locally occurs in a display panel.

In the display device of the present invention, it is preferable that: in a case where a comparison is made between: (a) the color difference $\Delta L^*$ between light emitted at 0° C. and light emitted at 40° C. which lights are emitted according to the signal voltage supplied to the driving transistor for displaying the center gray scale among the all display gray scale levels; and (b) the color difference $\Delta L^*$ between the light emitted at 0° C. and the light emitted at 40° C., which lights are emitted according to the signal voltage supplied to the driving transistor for displaying a gray scale level that is one level higher than the center gray scale, the signal voltage supplied to the driving transistor for displaying the center gray scale is set within a voltage region in which the color difference $\Delta L^*$ at displaying the gray scale level that is one level higher than the center gray scale level becomes smaller.

According to the arrangement, the color difference caused by temperature variation is smaller in the bright gray scale level side than in the dark gray scale side.

As a result, the temperature dependence of the color difference is reduced on a high gray scale level side (bright luminance side) on which visual perception of human beings is more sensitive. Therefore, the occurrence of luminance unevenness can be further reduced.

The color difference is calculated based on the formula of $L^*=116(Y/Y0)^{1/3}-16$ according to the National Bureau of Standards (US).

As explained above, in the display device of the present invention, the driving transistor flows a driving current in accordance with a signal voltage supplied via the data line, so that gray scale display in accordance with the signal voltage is carried out. The electro-optical element emits light in response to the driving current. The driving transistor is provided with the signal voltage at displaying the center gray scale among the all display gray scale levels within a voltage region in which the driving current in a temperature range of 0° C. to 40° C. is in a range of 98% to 102% of a driving current that flows at an average driving temperature.

As explained above, in the display device of the present invention, the driving transistor flows a driving current in accordance with a signal voltage into the electro-optical element, so that gray scale display is carried out in accordance with the signal voltage supplied via the data line. The electro-optical element emits light in response to the driving current. Moreover, the driving transistor is provided with the signal voltage at displaying the center gray scale among the all display gray scale levels within a voltage region in which a color difference between the light emitted in the temperature range of 0° C. to 40° C. and the light emitted at the average driving temperature becomes $\Delta L^*<1.5$ in the L*a*b* color solid.

A driving method of the display device of the present invention, as described above, is a method of providing the signal voltage to the driving transistor in a voltage region in which the driving current that flows in a temperature range of 0° C. to 40° C. into the electro-optical element at displaying the center gray scale among the all display gray scale levels is within a range of 98% to 102% of the driving current that flows at the average driving temperature.

Therefore, it is possible to provide, without cost increase or increase in mounting area, a display device in which the occurrence of luminance unevenness of the electro-optical element due to outside temperature variation or local temperature variation in the display panel is reduced and a driving method of the display device, that is, a display device having a low temperature dependence of luminance and a driving method of the display device.

NUMERAL REFERENCES

1 Display Device
2 Data Line

3 Scanning Line
4 Power Supply Line
6 Bypass Line
10 Pixel
11 Control Circuit
12 Source Driver Circuit
13 Gate Driver Circuit
16 Shift Register
17 Register
18 Latch
19 D/A Converter
20 EL Element
21 Retention Capacitor
31 First TFT (Switching Transistor)
32 Second TFT (Driving Transistor)
50 Ground
61 Transparent Substrate
62 Gate Insulation Film
63 Active Layer
64 Interlayer Insulation Film
65 Contact
66 Contact
67 Contact
68 Passivation Film
69 Light-Shielding Film
70 Planarization Layer
71 Gate Electrode
72 Source Electrode
73 Drain Electrode
74 Gate Electrode
75 Source Electrode
76 Drain Electrode
80 Transparent Electrode
91 Hole Transport Layer
92 Light Emitting Layer
93 Electron Transport Layer
94 Electron Injection Layer
95 Back Electrode
A Pixel Circuit
CLK Clock
DA Display Data
DLP Timing Pulse
G Scanning Signal
LP Latch Pulse
OE Timing Signal
S Data Signal
SP Start Pulse
Vgs Gate-Source Voltage
Id Drain Current
YI Start Pulse
YCK Clock

BEST MODE FOR CARRYING OUT THE INVENTION

The following explains one embodiment of the present invention, with reference to FIGS. 1 through 5.

A display device 1 of the present embodiment uses, as an electro-optical element, an organic EL that is a current-control type self-luminous electro-optical element.

(Circuit Configuration)

Figure 2:
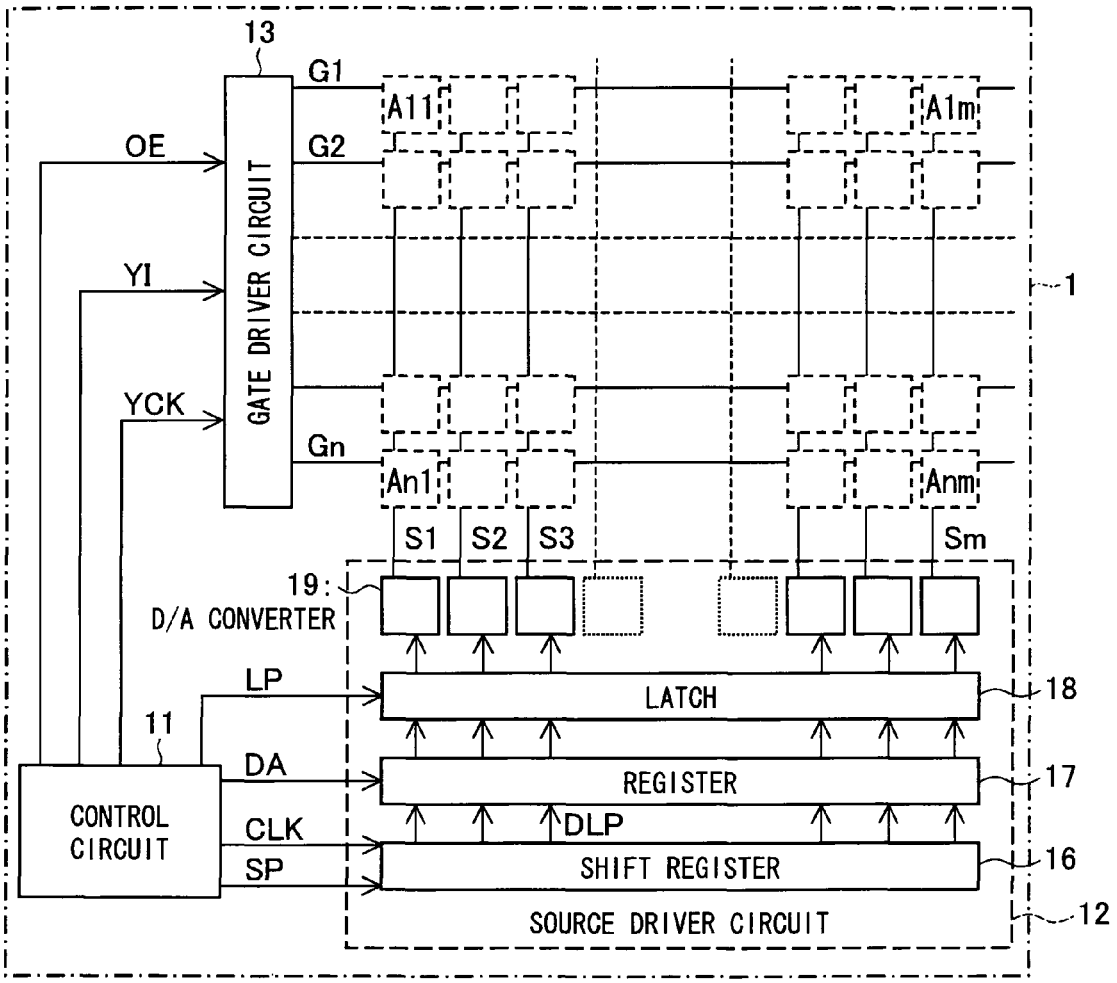
FIG. 2 is a diagram illustrating a circuit configuration of the display device of the present invention.

FIG. 2 is a diagram illustrating a circuit configuration of a display device 1 according to the present embodiment.

The display device 1 of the present embodiment includes a plurality of pixel circuits Aij (I=1 to n, j=1 to m), a control circuit 11, a source driver circuit 12, and a gate driver circuit 13.

The pixel circuits Aij are provided at respective intersections of (i) a plurality of data line Sj provided in parallel to one another and (ii) a plurality of scanning lines Gi that are provided orthogonal to the plurality of data lines Sj, respectively, and in parallel to one another. The data lines Sj are connected to the source driver circuit 12 so as to provide signals to the pixel circuits Aij. Meanwhile, the scanning lines Gi are connected to the gate driver circuit 13.

The source driver circuit 12 includes an m-bit shift register 16, a register 17, a latch 18, and m D/A (Digital/Analog) converters 19. The register 17 includes m register elements (not shown). The latch 18 includes m latch elements (not shown).

In this source driver circuit 12, the shift register 16 is cascade-connected to the m register elements. In other words, the shift register 16 is connected separately to each of the m register elements that correspond to the data lines Sj, respectively. Further, the register elements are connected separately to the m latch elements, respectively, and, in addition, separately to the m D/A converters 19.

On the other hand, the gate driver circuit 13 includes a shift register circuit (not shown), a logic operation circuit (not shown), and a buffer (not shown).

The source driver circuit 12 and the gate driver circuit 13 are controlled by the control circuit 11. That is, the control circuit 11 outputs, to the source driver circuit 12, a start pulse SP, a clock CLK, display data DA, and a latch pulse LP. Meanwhile, the control circuit 11 outputs, to the gate driver circuit 13, a timing signal OE, a start pulse YI, and a clock YCK.

(Circuit Operations in Display Device)

Next, operations of circuits in the display device 1 of the present embodiment are specifically explained.

(Control Circuit)

First, the control circuit 11 outputs a start pulse SP and a clock CLK to the shift register 16.

(Shift Register)

The shift register 16 transfers the start pulse SP that is inputted into a first bit of the shift register 16 from the control circuit 11, in synchronization with the clock CLK, so that the start pulse SP is outputted to the register 17 as a timing pulse DLP from each output stage (not shown) in the shift register 16.

(Register)

In to the register 17 into which the timing pulse DLP is inputted from the shift register 16, the display data DA is inputted from the control circuit 11 at the timing at which the timing pulse DLP is inputted.

Then, when one line of the display data DA, that is, m sets of the display data DA are stored in the register 17, the one line of the display data DA is inputted into the latch 18 in synchronization with the latch pulse LP that the control circuit 11 inputs into the latch.

(Latch)

The display data DA inputted into the latch 18 is outputted to each corresponding D/A converter 19.

(D/A Converter)

One D/A converter 19 is provided to each of the data signal lines Sj. The display data DA inputted from the latch 18 is outputted as an analog signal voltage Da to a corresponding data line Sj.

In the display device of the present embodiment, a range of the analog signal voltage Da that is outputted from the D/A converter is set in a voltage region whose temperature/voltage characteristic of the driving element later explained is lightly dependent on temperature. Accordingly, each of the drivers such as the source driver circuit 12 and the gate driver circuit 13 is constituted by, for example, a TFT that has a withstand voltage corresponding to the voltage range.

(Gate Driver Circuit)

Next, an operation of the gate driver circuit 13 is explained. This gate driver circuit 13, as discussed above, includes the shift register circuit (not shown), the logic operation circuit (not shown), and the buffer (not shown).

The gate driver circuit 13 transfers, into the shift register circuit in synchronization with the clock YCK, the start pulse YI inputted from the control circuit 11.

Then, in the logic operation circuit, a logic operation is performed by using (i) the pulse outputted from each output stage provided in the shift register circuit and (ii) the timing signal OE inputted from the control circuit 11. Then, a necessary voltage is outputted to a corresponding scanning line Gi via the buffer.

Each of the scanning lines Gi is connected with the plurality of pixel circuits Aij. The pixel circuits Aij are scanned by the scanning lines Gi one group unit at a time. Each group unit includes pixel circuits Aij connected to one scanning line Gi.

In this way, the source driver circuit 12 of the present embodiment is a line sequential scanning type circuit that transmits, at a time, data to pixel circuits Aij corresponding to one scanning line Gi. The source driver circuit 12 is not limited to the above configuration. The source driver circuit 12 may be a dot sequential scanning type circuit that sequentially transmits data to one pixel circuit Aij at a time.

(Operation of Pixel Circuit)

Figure 3:
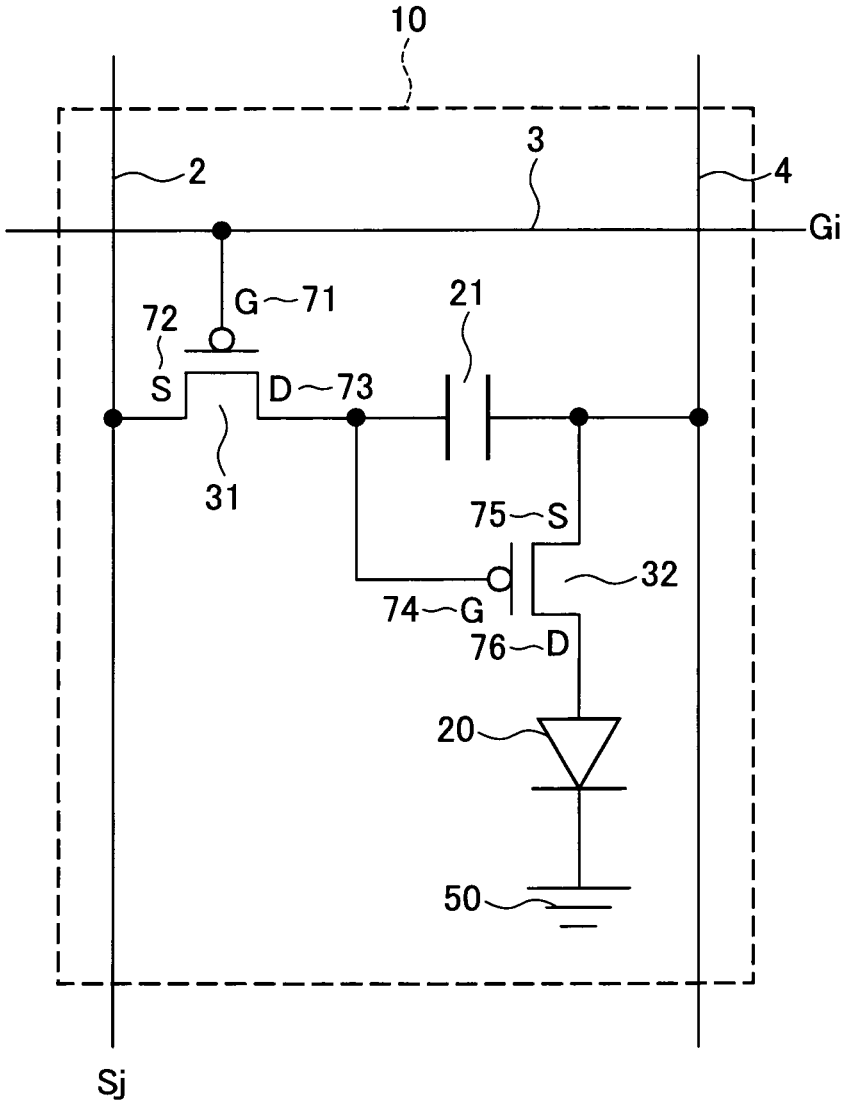
FIG. 3 is a diagram illustrating an equivalent circuit of a 2 TFT+1 C type circuit in a pixel.

The following explains an operation of each of the pixel circuits Aij provided in the display device 1, with reference to FIG. 3. The pixel circuit Aij in the present embodiment has a 2 TFT+1 C type circuit configuration. FIG. 3 is a diagram illustrating an equivalent circuit of a 2 TFT+1 C type circuit in a pixel.

In the pixel circuit Aij, when a selection signal is transmitted from the gate driver circuit (not shown) into the pixel circuit Aij via the scanning line Gi, the first TFT 31 as a switch Sw is turned on. Then, the analog signal voltage Da is written into the gate electrode 74 of the second TFT 32 as a driving TFT and the gate-source voltage Vgs is generated in the second TFT 32 as a driving TFT. Then, a current flows into the EL element 20 and the EL element 20 emits light. The retention capacitor 21 retains a voltage difference corresponding to the analog signal voltage Da.

Subsequently, the selection signal is turned off. This turns off the first TFT 31 as a switch Sw. Then, the second TFT 32 as a driving TFT is driven by an electric charge continuously stored in the retention capacitor 21.

In a case where this driving is driving carried out by amplitude modulation, a luminance is varied by oscillating the analog signal voltage Da. That is, the luminance is determined by the analog signal voltage Da.

On the other hand, in a case where the driving is driving by time-sharing, a luminance is varied by (i) keeping the analog signal voltage Da constant and (ii) changing, for every one frame, a light emission period. That is, the luminance is determined by the light emission period of each one frame.

In a case where the display device 1 is a full-color display device, the pixel circuits Aij are independently provided for three colors of R (Red), G (Green), and B (Blue), respectively. Then, the pixel circuits Aij corresponding to the colors are controlled by the source driver circuit 12 independently for each color. This makes it possible to realize any color and luminance.

(Temperature Dependence)

The following explains a relation between luminance and temperature.

Figure 1:
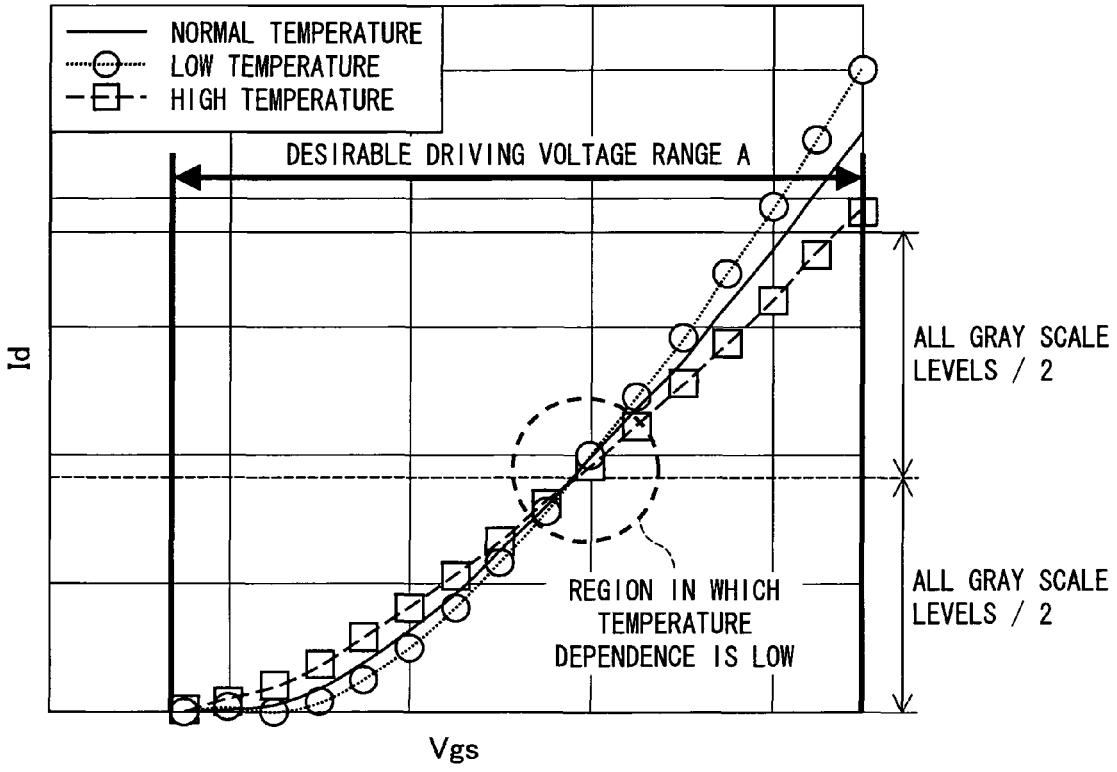
FIG. 1 is a diagram illustrating (i) a relation between a gate-source voltage and a drain current and (ii) a driving voltage range, in a driving TFT of a display device of the present invention.

FIG. 1 is a diagram illustrating (i) a relation between a gate-source voltage Vgs and a drain current Id and (ii) a driving voltage range of the second TFT 32 as a driving TFT in the present embodiment.

Generally, in a TFT, a current-voltage characteristic of the TFT tends to vary depending on temperature. This is considered to occur because, when a temperature varies, a threshold value Vth varies due to increase/decrease in capacity of a depletion layer or a mobility μ varies due to expansion/contraction of a mean free path.

Then, when the current-voltage characteristic of the TFT is heavily dependent on temperature in a case where the display element driven by the TFT is a current-control type self-luminous electro-optical element such as an EL element, for example, luminance unevenness caused by difference in temperature occurs.

As a result of examining temperature dependence of the current-voltage characteristic of the driving TFT, it is found that there is a voltage (Vgs) region in which the temperature dependence is low. A region in a dotted-line circle in FIG. 1 indicates the voltage (Vgs) region in which temperature dependence is low. An explanation is provided below.

In a TFT, generally, when a temperature rises, an increase in a capacity of a depletion layer decreases the threshold value Vth and a contraction in the mean free path decreases the mobility μ.

Then, in a voltage (Vgs) region of a low voltage, when a current value is determined, a variation in the threshold value Vth is more influential than a variation in the mobility μ. Accordingly, when a temperature rises, the current value rises.

On the other hand, in a voltage (Vgs) region of a high voltage, when a current value is determined, the variation in the mobility μ is more influential than the variation in the threshold value Vth. Accordingly, when a temperature rises, the current value lowers.

Accordingly, at a point where the rise of the current value accompanying the rise in temperature comes to equilibrium with the lowing of the current value due to the rise in temperature, a variation in a current value due to temperature variation, that is, temperature dependence of the current value disappears.

This forms the voltage (Vgs) region, as shown by the region in the dotted circle in FIG. 1, in which the current-voltage characteristic is less dependent on temperature.

The voltage at which the temperature dependence of the current value becomes low is determined by, for example, a condition of doping to a semiconductor region of the TFT, or an insulation film pressure of the TFT. Accordingly, in a case where TFTs of an identical structure are produced by an identical process, a voltage region in which temperature dependence of the current value is low becomes substantially the same in each TFT produced.

(Setting of Voltage Value)

In the second TFT 32 as a driving TFT for driving the EL element 20 in the display device 1 of the present embodiment, as illustrated in FIG. 1, an analog signal voltage Da of a gray scale level (center gray scale) corresponding to a middle of all gray scale levels is set within a voltage (Vgs) region in which temperature dependence of the current-voltage characteristic is low.

More concretely, the analog signal voltage Da of the center gray scale is set within a voltage region in which temperature dependence of the current value at a temperature in a range from 0° C. to 40° C. with respect to an average driving temperature (25° C.) is within a range of −2% to +2% in the temperature dependence of the current-voltage characteristic of the driving TFT.

The description that the temperature dependence of the current value is within the range of −2% to +2% means that a driving voltage at temperatures other than the average driving temperature is within a range of 98% to 102% of the driving voltage at the average driving temperature.

It is more preferable to set the analog signal voltage Da of the center gray scale so that the temperature dependence of the current value is in a range of −2% to +2% at a temperature in a range from 0° C. to 80° C., that is, the driving current at the temperatures other than the average driving temperature is within a range of 98% to 102% of the driving current at the average driving temperature.

Further, it is desirable that a voltage on a side of a gray scale level slightly brighter than the center gray scale on which side a human being is more sensitive to brightness at the gray scale level is arranged to correspond to the voltage (Vgs) region in which temperature dependence is low. More specifically, it is desirable to set the analog signal voltage Da of the center gray scale to a voltage slightly lower than a voltage value (an average voltage value between the maximum voltage and the minimum voltage in the region) at the center of a voltage range of the voltage (Vgs) region in which the temperature dependence is low. That is, the region is set to correspond to a voltage on a side of a brighter luminance compared with a luminance of the center gray scale of a display gray scale. This makes it possible to achieve driving in which visual perception is less dependent on temperature at all gray scale levels of the display gray scale.

The following explains how to set the voltage value in detail.

Temperature dependence or the like of, for example, various voltage conditions is experimentally examined. As a result, it is found that an overdrive voltage at which temperature dependence of the current value is low is approximately 3 V to 5 V in the case of the TFT using CG silicon. Accordingly, it is preferable to set a driving voltage range so that Vgs−Vth=3 V to 5 V.

When this overdrive voltage is arranged to correspond to the analog signal voltage Da at the center gray scale, the driving voltage range becomes approximately 4 V to 7 V. This driving voltage range is higher than a conventional driving voltage range.

TABLE 1

Comparison Between Present Embodiment and Conventional Example

| | Driving Voltage at Highest Brightness (Vgs) | Temperature Dependence of Current Value at Highest Brightness | Temperature Dependence of Current Value at Center Gray Scale |
|---|---|---|---|
| Present Embodiment | >4 V | Negative | Substantially Zero |
| Conventional Example | <2~3 V | Positive | Positive |

Table 1 is a table comparing the display device 1 of the present embodiment and a conventional display device (conventional example).

Here, in the display 1 of the present embodiment, the driving voltage is set within a driving voltage range A as shown in FIG. 1.

More specifically, the analog signal voltage (Vgs−Vth) at the center gray scale is 4.2 V and a driving voltage range for all gray scale levels is set to 0 V to 6.0 V.

Figure 6:
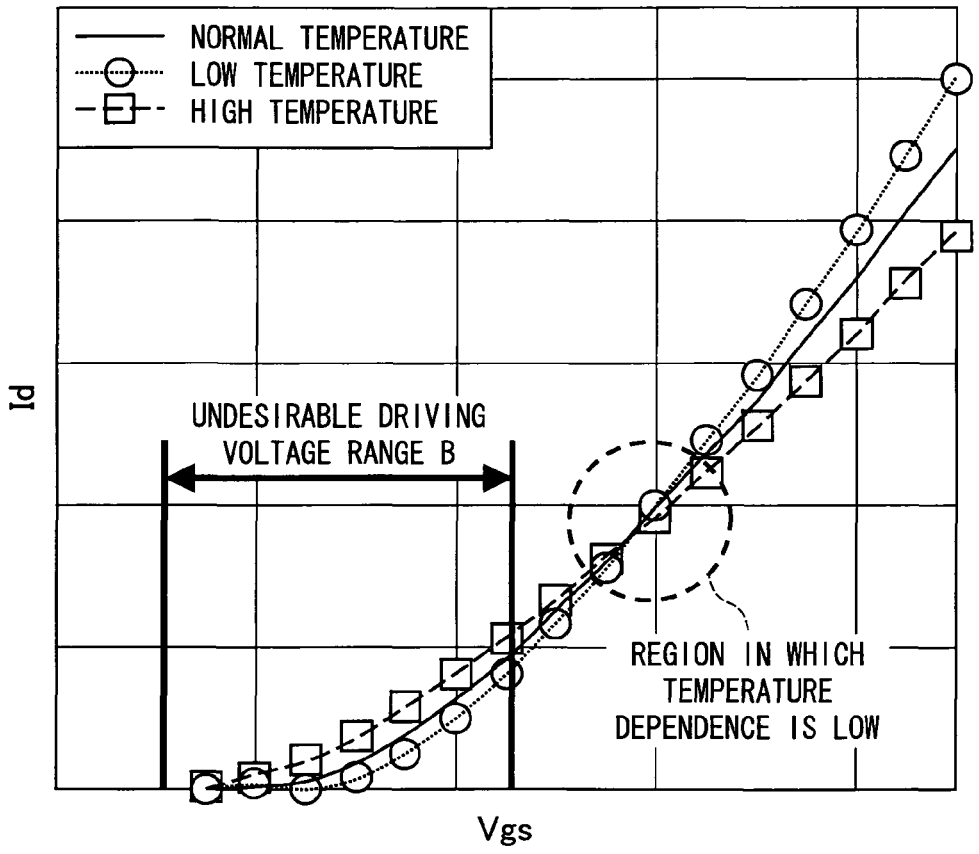
FIG. 6 is a diagram illustrating (i) a relationship between a gate-source voltage and a drain current and (ii) a driving voltage range, in a driving TFT of a conventional display device.

On the other hand, in the conventional example, the driving voltage is set to the driving voltage range B as shown in FIG. 6.

More specifically, an analog signal voltage (Vgs−Vth) at the center gray scale is 2.1 V and a driving voltage range for all gray scale levels is set to 0 V to 3.1 V.

FIG. 6 is a diagram illustrating (i) a relation between a gate-source voltage and a drain current and (ii) a driving voltage range in a driving TFT of the conventional example.

In the conventional example, the driving voltage range, that is, a driving voltage amplitude is set to be narrow within a low voltage region. Accordingly, the driving voltage range does not include a voltage (Vgs) region in which temperature dependence of a current of the TFT is low. Accordingly, the temperature dependence of the current is positive always (time having the highest brightness or the center gray scale inclusive). Accordingly, when the temperature becomes high, the luminance becomes high. This luminance variation due to temperature variation is particularly large on a low gray scale level side. As a result, luminance unevenness of the electro-optical element often occurs due to the temperature variation.

On the contrary to the conventional example, in the display device 1 of the present embodiment, the voltage (Vgs) region in which the temperature dependence of the current of the TFT is low is arranged to correspond to a voltage range in the vicinity of a gray scale level corresponding to a middle of all the gray scale levels. Further, the analog signal voltage Da on a side of a gray scale level brighter than the center gray scale is set to a center voltage in the voltage (Vgs) region in which the temperature dependence is low. This reduces the occurrence of luminance unevenness of the electro-optical element due to temperature variation.

Figure 7:
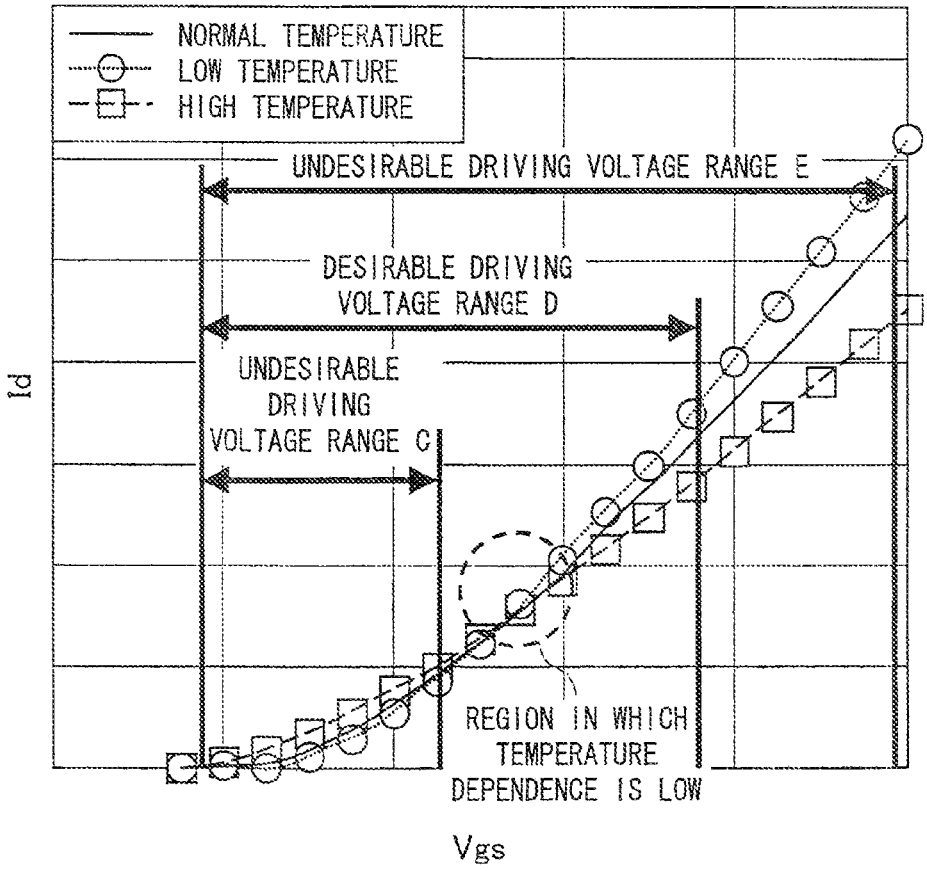
FIG. 7 is a diagram illustrating (i) a relationship between a gate-source voltage and a drain current and (ii) driving voltage ranges, in driving TFTs of display devices.

As shown in FIG. 7, not only in a case where the driving voltage range is set to a range that does not include the region in which dependence of the current value of the TFT on the temperature is low (i.e., the driving voltage range B of FIG. 6, and a driving voltage range C of FIG. 7) but also in a case where the driving voltage range is set to a range including the region in which temperature dependence is low, it is not possible to reduce the occurrence of luminance unevenness of the electro-optical element due to temperature variation when the analog signal voltage Da in the vicinity of the center gray scale is not within the range where the temperature dependence is low (i.e., the driving voltage range E of FIG. 7). That is, in such a case, luminance unevenness due to temperature variation becomes significant on both of a high gray scale level side and a low gray scale level side. FIG. 7 is a diagram illustrating (i) a relation between a gate-source voltage and a drain current and (ii) a driving voltage ranges in driving TFTs of respective display devices. The driving voltage range C and a driving voltage range E of FIG. 7 show conventional driving voltage ranges. The driving voltage D shows a driving voltage range of the present embodiment.

(Production Method)

A production method of the display device 1 of the present embodiment is explained below, with reference to FIGS. 4 and 5.

Figure 4:
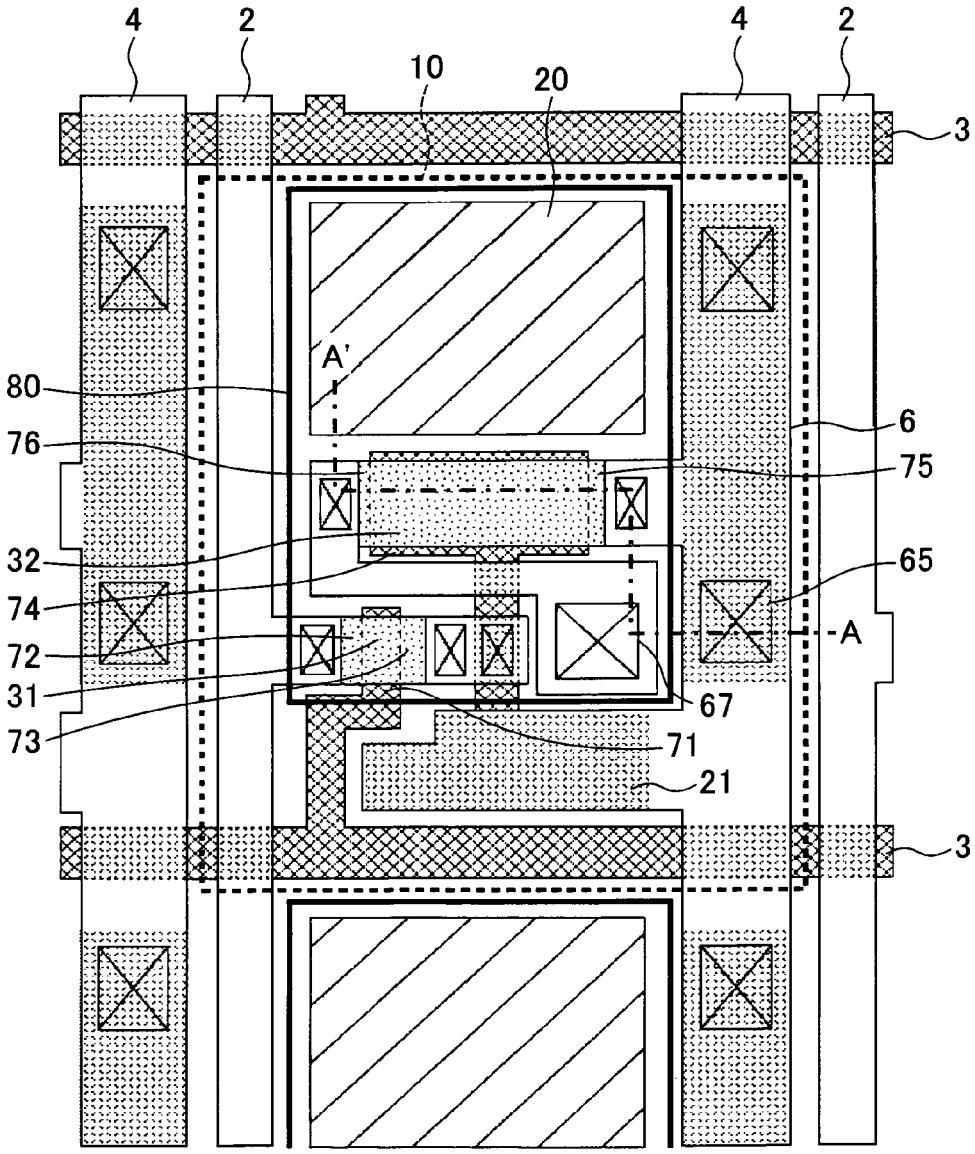
FIG. 4 is a plan view illustrating a pixel of a display device of a present embodiment.

FIG. 4 is a plan view of a pixel of the display device of the present embodiment. FIG. 5 is a cross sectional view taken along A-A' in FIG. 4 and shows the second TFT 32 of the pixel 10 at the center. A left side of FIG. 5 corresponds to a side A of FIG. 4.

The display device 1 of the present embodiment is a bottom-emission type EL display device that emits light from a back surface of a substrate. The TFT included in the EL display device is a bottom-gate type transistor in which a gate electrode is provided on a bottom surface side of the substrate.

Figure 5:
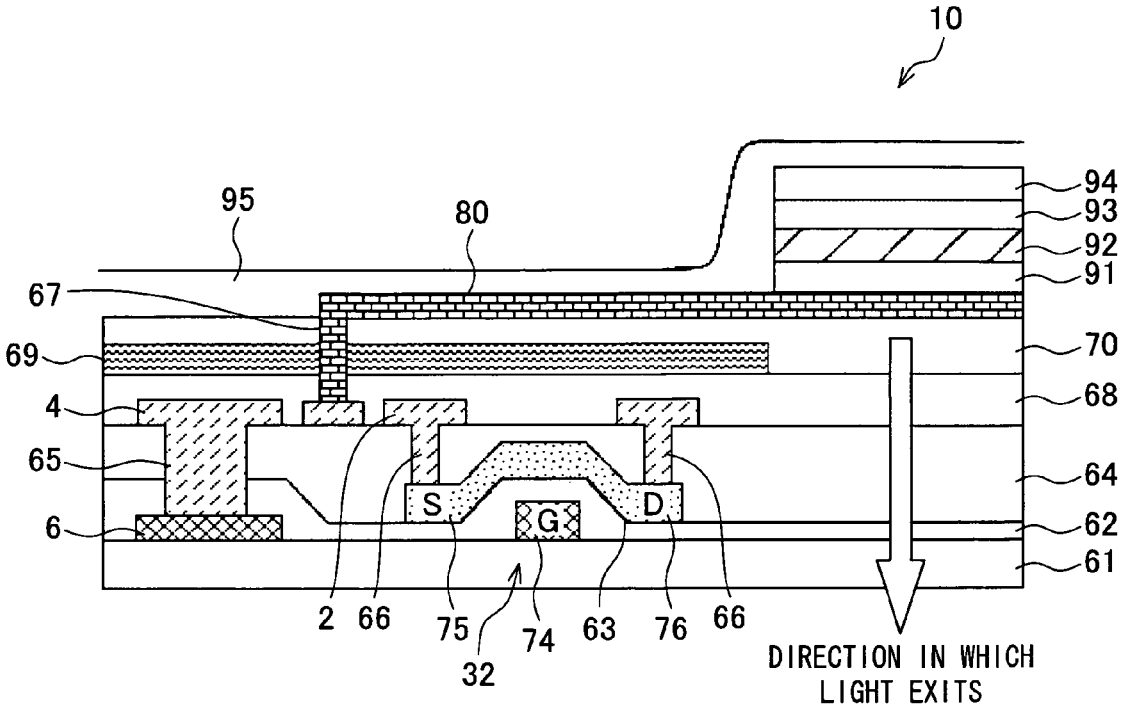
FIG. 5 is a cross sectional view taken along a line A-A' in FIG. 4.

As shown in FIG. 5, the display device 1 of the present embodiment is produced by forming, according to a conventional technique, various layers on a substrate made of a transparent substrate 61 that is a transparent substrate whose surface at least is insulative. An example of a material of this transparent substrate 61 is glass or synthetic resin.

More specifically, a first wiring layer, a gate insulation film 62, an active layer 63, an interlayer insulation film 64, a second wiring layer are provided in this order on the transparent substrate 61. The pixel 10 as shown in FIG. 4 is formed mainly by these layers.

(First Wiring Layer)

The first wiring layer includes a gate electrode 74 of the second TFT 32, a bypass line 6, a scanning line 3 (See FIG. 4), a gate electrode 71 of the first TFT 31 (See FIG. 4), a lower electrode of the retention capacitor 21.

As shown in FIG. 4, the scanning line 3 and the gate electrode 71 of the first TFT 31 are electrically connected. Moreover, the gate electrode 74 of the second TFT 32 and the lower electrode of the retention capacitor 21 are electrically connected.

Metal, such as chrome or thallium, having a high fusing point is used as a material of the first wiring layer, corresponding to that polycrystalline silicon or amorphous silicon is used in an upper layer.

(Gate Insulation Film and Active Layer)

Next, as shown in FIG. 5, the gate insulation film 62 is formed substantially all over the transparent substrate 61. Subsequently, the active layer 63 is formed. This gate insulation film 62 and the active layer 63 have a film thickness of approximately several tens of nanometers.

This active layer 63 is made into a channel of the first TFT and a channel of the second TFT 32, by selectively edging the active layer 63 with the use of a photo mask.

(Interlayer Insulation Film)

Next, the interlayer insulation film 64 is formed substantially all over the transparent substrate 61. Subsequently, a through hole that penetrates the gate insulation film 62 and the interlayer insulation film 64 is formed at a position to be provide with a contact 65 for electrically connecting the first wiring layer and the second wiring layer explained next. In addition, a through hole penetrating the interlayer insulation film 64 is formed at a position to be provided with a contact 66 for electrically connecting the active layer 63 and the second wiring layer.

(Second Wiring Layer)

Next, the second wiring layer is provided substantially all over the transparent substrate 61. This second wiring layer includes, for example, the power supply line 4, the data line 2, an upper electrode of the retention capacitor 21, a wiring to be connected to the drain electrode 76 of the second TFT 32.

In addition, disposition regions for formation of the contact 65, the contact 66, and the contact 67 are formed. The contact 65 electrically connects the first wiring layer and the second wiring layer. The contact 66 electrically connects the active layer 63 and the second wiring layer. The contact 67 electrically connects a transparent electrode 80 explained below and the second wiring layer.

Then, when the second wiring layer is formed, the through hole for formation of the contacts 65 and 66 are filled with a material that is the same material as a metal material forming the second wiring layer. This electrically connects the power supply line 4 and the bypass line 6 by the contact 65, as shown in FIG. 5. Moreover, each of the source electrode 75 and the drain electrode 76 of the second TFT 32 is electrically connected to the second wiring layer by the contact 66.

In this second wiring layer, electrical connections are made respectively (i) between the power supply line 4 and the upper electrode of the retention capacitor 21, (ii) between the power supply line 4 and the source electrode 75 of the second TFT 32, (iii) between the drain electrode 76 of the second TFT 32 and the disposition region of the contact 67, (iv) between the data line 2 and the source electrode 72 of the first TFT 31, and (v) the drain electrode 73 of the first TFT 31 and the gate electrode 74 of the second TFT 32.

(Passivation Film and Others)

Next, the passivation film 68, the light-shielding film 69, and the planarization film 70 are provided substantially all over the transparent substrate 61. A film thickness of the passivation film 68 is approximately 0.3 μm. A film thickness of the light-shielding film 69 is approximately 1.5 μm. A film thickness of the planarization film 70 is approximately 3.5 μm. The light-shielding film 69 is formed so as to cover the first TFT 31 and the second TFT 32.

Then, a through hole penetrating the passivation film 68, the light-shielding film 69, and the planarization film 70 are formed at the position where the contact 67 is to be provided.

(Transparent Electrode)

Next, the transparent electrode 80 is provided substantially all over the transparent substrate 61 and formed in a desired shape. In the formation of the transparent electrode 80, the contact 67 is formed by filling the through hole with a material that is the same as a material of the transparent electrode 80. An example of the material of the transparent electrode 80 is, for example, ITO (Indium Tin Oxide).

(EL Element)

Next, a layer constituting the EL element 20 is formed.

More specifically, a hole transport layer 91, a light emitting layer 92, an electron transport layer 93, and an electron injection layer 94 are formed on the transparent electrode 80.

(Back Electrode)

Next, a back electrode 95 is formed by using a metal material substantially all over the transparent substrate 61. The back electrode 95 functions as a negative electrode of the EL element 20.

At the end, the transparent substrate 61 is sealed for protecting the EL element 20 from, for example, water. By the process explained above, the display device 1 including the EL element 20 of the present embodiment can be produced.

The present invention is not limited to the embodiments. The present invention may be variously modified within the scope of the present invention.

For example, the analog signal voltage Da of the center gray scale may be set to a voltage region in which, in terms of the temperature dependence of the current-voltage characteristic of the driving TFT, the temperature dependence of the current in a temperature range of 0° C. to 40° C. with respect to an average driving temperature is in a range of −(1/the number of all display gray scale levels)×100% to +(1/the number of all display gray scale levels)×100%.

Here, the description that the temperature dependence of the current value is in a range from −(1/the number of all display gray scale levels)×100% to +(1/the number of all display gray scale levels)×100% means that the driving voltage at a temperature other than the average driving temperature is in a range of {1−(1/the number of all display gray scale levels)}×100% to +{1+(1/the number of all display gray scale levels)}×100% of the driving current of the average driving temperature.

The average driving temperature with respect to the temperature dependence is not limited to 25° C. but may be other temperature such as a temperature of 27° C.

The driving voltage range is not limited to 4V to 7V. In accordance with each of various processes, any driving voltage satisfying conditions recited in claims can be set to.

The TFT used for switching, driving, or the like, is not specifically limited. The TFT may be made of, for example, a low-temperature polysilicon TFT, a CG (Continuous Grain) silicon TFT, or an amorphous silicon TFT. The CG silicon means a technique of forming an Si film made of silicon similar to single-crystal silicon on the glass substrate.

INDUSTRIAL APPLICABILITY

The present invention is suitably applied to a current-control type electro-optical element such as an organic EL (Electro Luminescence) element, an FED (Field Emission Display) element, or an LED (Light Emitting Diode) element.

The invention claimed is:

1. A display device comprising:

a data line; and pixels in each of which at least a driving transistor and an electro-optical element are formed, the driving transistor supplying a driving current in accordance with a signal voltage into the electro-optical element so as to carry out gray scale display in accordance with the signal voltage supplied via the data line, wherein the driving transistor has a reference voltage value for the signal voltage at which the driving current that flows is unchanged with respect to a given magnitude of the signal voltage, if a temperature of the driving transistor remains within a temperature range of 0° C. to 40° C., on a lower voltage side than the reference voltage value, as temperature becomes higher, the driving current increases with respect to one given magnitude of the signal voltage which is lower than the reference voltage value, on a higher voltage side than the reference voltage value, as temperature becomes higher the driving current decreases with respect to another given magnitude of the signal voltage which is higher than the reference voltage value, the driving transistor has a reference voltage range for the signal voltage, the reference voltage range including the reference voltage value, and within the reference voltage range, even in the case where the temperature varies within the temperature range of 0° C. to 40° C. with respect to the given magnitude of the signal voltage, the driving current that flows falls within a range of 98% to 102% of the driving current that flows at 25° C., the electro-optical element emits light in response to the driving current, and the display device is configured to reduce an unevenness in a luminance of the light by setting the signal voltage at displaying a center gray scale among all display gray scale levels to be within the reference voltage range that includes the reference voltage value such that the reference voltage value is greater than or equal to the signal voltage at the displaying of the center gray scale.

2. A display device as set forth in claim 1, wherein:

the signal voltage, at displaying the center gray scale among the all display gray scale levels, is supplied to the driving transistor, the signal voltage being within a voltage region in which the driving current in the temperature range of 0° C. to 40° C. is in a range of {1−(1/a number of the all display gray scale levels)}×100% to {1+(1/the number of the all display gray scale levels)}×100% of the driving current that flows at 25° C.

3. The display device as set forth in claim 1, wherein:

the temperature range is from 0° C. to 80° C.

4. The display device as set forth in claim 1, wherein:

the gray scale display is carried out by amplitude modulation.

5. The display device as set forth in claim 1, wherein:

the gray scale display is carried out by time modulation.

6. The display device as set forth in claim 1, wherein:

in a case where a comparison is made between:

(a) a difference between the driving current that flows at 0° C. and the driving current that flows at 40° C., the driving currents being caused by the driving voltage supplied to the driving transistor so as to display the center gray scale among the all display gray scale levels; and (b) a difference between the driving current that flows at 0° C. and the driving current that flows at 40° C., the driving currents being caused by the driving voltage supplied to the driving transistor so as to display a gray scale level that is one level higher than the center gray scale among the all display gray scale levels, the signal voltage supplied to the driving transistor for displaying the center gray scale is set within a voltage region in which the difference at displaying the gray scale level that is one level higher than the center gray scale level becomes smaller.

7. The display device as set forth in claim 1, further comprising:

a gate electrode and a source electrode formed in the driving transistor;

a switching transistor formed between the data line and the gate electrode of the driving transistor; and a retention capacitor formed between the gate electrode of the driving transistor and the source electrode of the driving transistor, the signal voltage being supplied to the driving transistor via the switching transistor in a period in which the switching transistor is on, the signal voltage, that is supplied to the driving transistor in the period in which the switching transistor is on, being retained by a capacitor stored in the retention capacitor in a period in which the switching transistor is off.

8. The display device as set forth in claim 1, wherein:

the electro-optical element is an organic EL element.

9. The display device as set forth in claim 1, wherein:

the driving transistor is a thin film transistor and includes a channel region made of polycrystalline silicon.

10. The display device as set forth in claim 1, wherein:

the pixels include at least three kinds of pixels including a pixel displaying a red color, a pixel display a green color, and a pixel displaying a blue color.

11. A display device comprising:

a data line; and pixels in each of which at least a driving transistor and an electro-optical element are formed, the driving transistor supplying a driving current in accordance with a signal voltage into the electro-optical element so as to carry out gray scale display in accordance with the signal voltage supplied via the data line and the electro-optical element emitting light in response to the driving current, wherein the driving transistor has a reference voltage value for the signal voltage at which the driving current that flows is unchanged with respect to a given magnitude of the signal voltage, if a temperature of the driving transistor remains within a temperature range of 0° C. to 40° C., on a lower voltage side than the reference voltage value, as temperature becomes higher, the driving current increases with respect to one given magnitude of the signal voltage which is lower than the reference voltage value, on a higher voltage side than the reference voltage value, as temperature becomes higher the driving current decreases with respect to another given magnitude of the signal voltage which is higher than the reference voltage value, the driving transistor has a reference voltage range for the signal voltage, the reference voltage range including the reference voltage value, and within the reference voltage range, even in the case where the temperature varies within the temperature range of 0° C. to 40° C. with respect to the given magnitude of the signal voltage, a color difference between light emitted within the temperature range of 0° C. to 40° C. and light emitted at 25° C. is $\Delta L^*<1.5$ in an L*a*b*, and the display device is configured to reduce an unevenness in a luminance of the light by setting the signal voltage at displaying a center gray scale among all display gray scale levels to be within the reference voltage range that includes the reference voltage value such that the reference voltage value is greater than or equal to the signal voltage at the displaying of the center gray scale.

12. The display device as set forth in claim 11, wherein:

in a case where a comparison is made between:

(a) the color difference $\Delta L^*$ between light emitted at 0° C. and light emitted at 40° C. which lights are emitted according to the signal voltage supplied to the driving transistor for displaying the center gray scale among the all display gray scale levels; and (b) the color difference $\Delta L^*$ between the light emitted at 0° C. and the light emitted at 40° C., which lights are emitted according to the signal voltage supplied to the driving transistor for displaying a gray scale level that is one level higher than the center gray scale, the signal voltage supplied to the driving transistor for displaying the center gray scale is set within a voltage region in which the color difference $\Delta L^*$ at displaying the gray scale level that is one level higher than the center gray scale level becomes smaller.

13. A method of driving a display device, the display device including a data line and pixels in each of which at least a driving transistor and an electro-optical element are formed, the driving transistor supplying a driving current in accordance with a signal voltage into the electro-optical element so as to carry out gray scale display in accordance with the signal voltage supplied via the data line, wherein the driving transistor has a reference voltage value for the signal voltage at which the driving current that flows is unchanged with respect to a given magnitude of the signal voltage, if a temperature of the driving transistor remains within a temperature range of 0° C. to 40° C., on a lower voltage side than the reference voltage value, as temperature becomes higher, the driving current increases with respect to one given magnitude of the signal voltage which is lower than the reference voltage value, on a higher voltage side than the reference voltage value, as temperature becomes higher the driving current decreases with respect to another given magnitude of the signal voltage which is higher than the reference voltage value, the driving transistor has a reference voltage range for the signal voltage, the reference voltage range including the reference voltage value, and within the reference voltage range, even in the case where the temperature varies within the temperature range of 0° C. to 40° C. with respect to the given magnitude of the signal voltage, the driving current that flows falls within a range of 98% to 102% of the driving current that flows at 25° C., the method comprising:

reducing an unevenness in a luminance of the light by setting the signal voltage at displaying a center gray scale among all display gray scale levels to be within the reference voltage range that includes the reference voltage value such that the reference voltage value is greater than or equal to the signal voltage at the displaying of the center gray scale.

14. The display device as set forth in claim 2, wherein:

the temperature range is from 0° C. to 80° C.

15. The display device as set forth in claim 2, wherein:

the gray scale display is carried out by amplitude modulation.

16. The display device as set forth in claim 2, wherein:

the gray scale display is carried out by time modulation.

17. The display device as set forth in claim 2, wherein:

in a case where a comparison is made between:

(a) a difference between the driving current that flows at 0° C. and the driving current that flows at 40° C., the driving currents being caused by the driving voltage supplied to the driving transistor so as to display the center gray scale among the all display gray scale levels; and (b) a difference between the driving current that flows at 0° C. and the driving current that flows at 40° C., the driving currents being caused by the driving voltage supplied to the driving transistor so as to display a gray scale level that is one level higher than the center gray scale among the all display gray scale levels, the signal voltage supplied to the driving transistor for displaying the center gray scale is set within a voltage region in which the difference at displaying the gray scale level that is one level higher than the center gray scale level becomes smaller.

18. The display device as set forth in claim 2, further comprising:

a gate electrode and a source electrode formed in the driving transistor;

a switching transistor formed between the data line and the gate electrode of the driving transistor; and a retention capacitor formed between the gate electrode of the driving transistor and the source electrode of the driving transistor, the signal voltage being supplied to the driving transistor via the switching transistor in a period in which the switching transistor is on, the signal voltage, that is supplied to the driving transistor in the period in which the switching transistor is on, being retained by a capacitor stored in the retention capacitor in a period in which the switching transistor is off.

19. The display device as set forth in claim 2, wherein:

the electro-optical element is an organic EL element.

20. The display device as set forth in claim 2, wherein:

the driving transistor is a thin film transistor and includes a channel region made of polycrystalline silicon.

21. The display device as set forth in claim 2, wherein:

the pixels include at least three kinds of pixels including a pixel displaying a red color, a pixel display a green color, and a pixel displaying a blue color.

* * * * *